US007462095B2

(12) United States Patent
Leder et al.

(10) Patent No.: US 7,462,095 B2
(45) Date of Patent: Dec. 9, 2008

(54) APPARATUS AT A FLAT CARD OR ROLLER CARD FOR GRINDING A CLOTHING DRAWN ONTO A ROTATING ROLLER

(75) Inventors: Armin Leder, Mönchengladbach (DE); Gerd Pferdmenges, Jüchen (DE); Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 99 days.

(21) Appl. No.: 11/602,985

(22) Filed: Nov. 22, 2006

(65) Prior Publication Data

US 2007/0117498 A1 May 24, 2007

(30) Foreign Application Priority Data

Nov. 22, 2005 (DE) ..... 10 2005 055 916

(51) Int. Cl.
*B24B 19/00* (2006.01)

(52) U.S. Cl. ..... 451/416; 451/172; 451/184

(58) Field of Classification Search ..... 451/164, 451/172, 173, 184, 324, 416, 417, 424
See application file for complete search history.

(56) References Cited

U.S. PATENT DOCUMENTS

| | | | | |
|---|---|---|---|---|
| 3,881,281 | A | 5/1975 | Hollingsworth | |
| 4,984,395 | A * | 1/1991 | Demuth | 451/49 |
| 5,277,000 | A * | 1/1994 | Demuth et al. | 451/416 |
| 5,797,788 | A * | 8/1998 | Graf et al. | 451/28 |
| 5,853,318 | A | 12/1998 | Thom et al. | |
| 5,894,636 | A | 4/1999 | Sauter et al. | |
| 6,106,381 | A * | 8/2000 | Leder et al. | 451/416 |
| 6,431,969 | B1 * | 8/2002 | Sauter et al. | 451/416 |
| 6,863,591 | B2 | 3/2005 | Graf | |
| 7,131,896 | B2 * | 11/2006 | Faas et al. | 451/184 |
| 2007/0128984 | A1 * | 6/2007 | Leder et al. | 451/5 |

FOREIGN PATENT DOCUMENTS

DE 93 13 633 U1 2/1994

(Continued)

OTHER PUBLICATIONS

United Kingdom Search Report dated Jun. 13, 2007, issued in Application No. GB0623016.3.

(Continued)

*Primary Examiner*—Eileen P. Morgan
(74) *Attorney, Agent, or Firm*—Venable LLP; Robert Kinberg; Justine A. Gozzi

(57) ABSTRACT

In an apparatus at a carding machine for grinding a clothing drawn onto a rotating roller, having a carrying device with at least one grinding element and an advancing device serving to set the grinding element against the clothing, wherein the apparatus comprises a biasing device serving for automatically continuing to push forward the grinding element in a contact-making direction during the grinding procedure, the carrying device is attached to the carding machine. In order to make it possible, by simple means, to shorten the time until service-readiness carrying elements adjusted in respect of the spacing b relative to the roller are utilized for adjustment of the biasing device.

22 Claims, 7 Drawing Sheets

FOREIGN PATENT DOCUMENTS

| | | | |
|---|---|---|---|
| DE | 196 05 635 | A1 | 8/1997 |
| DE | 103 18 968 | A1 | 11/2004 |
| EP | 0 497 736 | A1 | 8/1992 |
| EP | 1 430 997 | A1 | 6/2004 |
| GB | 111216 | A | 11/1917 |
| GB | 775123 | A | 5/1957 |
| GB | 2 421 250 | A | 6/2006 |

OTHER PUBLICATIONS

German Search Report dated Nov. 22, 2005, issued in DE 10 2005 055 916.6.

* cited by examiner

A-A

B-B

APPARATUS AT A FLAT CARD OR ROLLER CARD FOR GRINDING A CLOTHING DRAWN ONTO A ROTATING ROLLER

CROSS REFERENCE TO RELATED APPLICATION

The present application claims priority from German Patent Application No. 10 2005 055 916.6 dated Nov. 22, 2005, the entire disclosure of which is incorporated herein by reference.

BACKGROUND OF THE INVENTION

The invention relates to an apparatus at a flat card or roller card for grinding a clothing drawn onto a rotating roller. Some grinding devices have a carrying device with at least one grinding element and an advancing device serving to set the grinding element against the clothing, the apparatus comprising a biasing device serving for automatically continuing to push forward the grinding element in a contact-making direction during the grinding procedure, and the carrying device being attached to the flat card or roller card.

When textile fibres are processed, the fibres are oriented and cleaned with the aid of flat cards or roller cards. Those fibre-processing apparatuses comprise at least one roller having a wall in the shape of a circular cylinder and carrying a fibre-processing clothing on its outer wall surface. For fibre processing, the roller is set in rotary motion relative to its cylinder axis. The clothing arranged on the outer wall surface passes through the fibre material and orients it, optionally in co-operation with further processing elements such as, for example, card flats, clearer rollers and the like. Cleaning of the raw material is, furthermore, also achieved by the fibre processing. In order to increase resistance to wear and to improve the quality of the textile fibre material, a so-called all-steel saw-tooth clothing is usually used as the fibre-processing clothing. A clothing of such a kind comprises a saw-tooth wire running on a helical course around the roller having a wall in the shape of a circular cylinder, the saw-teeth of which wire pass through the fibre material. In operation of the above-described wires, considerable wear of the fibre-processing clothing takes place. In addition, contaminants can gather in the region of that clothing. The latter-described problem especially comes to the fore when processing synthetic fibres, in the course of which the fibres can melt and stick to the clothing. Therefore, in order to achieve the desired quality of fibre material, it is necessary for the fibre-processing clothing to undergo processing regularly in order, in the course of that processing, to re-grind the tips of the clothing and/or to remove contaminants from the clothing.

In the case of a known apparatus (EP 1 430 997 A), after mounting of the grinding arrangement on the machine frame of a flat card or roller card, the desired orientation of the grinding arrangement with respect to the clothing to undergo processing is first adjusted with the aid of an adjusting screw. By that means, the contact pressure (biasing device) of the grinding element against the clothing is adjusted. The processing arrangement is then lifted up off the clothing by actuating a pneumatic lifting cylinder, the roller together with the clothing is caused to rotate and the processing arrangement is advanced towards the clothing by again actuating the pneumatic lifting cylinder. It is disadvantageous that the biasing of the grinding arrangement has to be adjusted in an additional preparatory step, for which the grinding element is firstly set against the non-rotating clothing. In addition, for adjustment of the biasing device, additional outlay in terms of apparatus and installation is required. It is furthermore disadvantageous that, in the case of mobile use or replacement of the apparatus, the time-consuming adjustment procedure is additionally required.

It is an aim of the invention to provide an apparatus of the kind described at the beginning that avoids or mitigates the mentioned disadvantages and that especially is simple in terms of construction and installation and makes it possible to shorten the time until service-readiness for advancing the grinding apparatus and for the grinding procedure.

SUMMARY OF THE INVENTION

The invention provides a grinding device for grinding a clothing on a rotating roller of a carding machine, comprising:

- a carrying device with at least one grinding element and an advancing device serving to set the grinding element(s) against the clothing; and
- a biasing device for automatically continuing to push forward the grinding element(s) in a contact-making direction during the grinding procedure; wherein the grinding device is so arranged that carrying elements of the carding machine adjustable for changing a spacing between the roller and a machine element opposed thereto are utilisable for adjustment of the biasing device.

As a result of the fact that carrying elements at the sides, having already defined reference points, are associated with the carrier device having the biasing device for the at least one grinding element, the outlay in terms of apparatus and the time required for service-readiness are substantially reduced. Compared to the known apparatus, separate or additional adjustment of the biasing device is no longer necessary. In especially advantageous manner, the constructionally already predetermined defined spacings at the side parts are utilised for that purpose.

Advantageously, the grinding device is so configured and dimensioned that it is interchangeable with a cover element and/or a work element of the carding machine. Advantageously, on both sides of the roller there are provided side parts having carrying elements, the peripheral region of which has in the radial direction predetermined spacings relative to a reference point of the roller, and the carrying device of the grinding apparatus is associated with the carrying elements of the side parts. Advantageously, at least one grinding element is arranged to be displaced, during the grinding procedure, in the direction of a displacement path extending perpendicular to the contact-making device. Advantageously, the biasing device is arranged to be displaced in the direction of the displacement path together with the at least one grinding element. Advantageously, the at least one grinding element has an articulated connection to the biasing device by means of a joint. Advantageously, a universal joint is used. Advantageously, the direction of displacement during the grinding process is reversible. Advantageously, the carrier, together with the biasing device for the at least one grinding element, is arranged to be moved or advanced in the contact-making direction. Advantageously, the biasing device comprises a spring, for example a helical spring. Advantageously, in the direction of the clothing surface to be ground, a plurality of grinding elements are provided. Advantageously, with each grinding element there is associated a biasing device, to which it has an articulated connection. Advantageously, at least one grinding element carries out an oscillating or reciprocating movement back and forth during the grinding process. Advantageously, the carrier is mounted on the extension bends of a flat card or roller card. Advantageously, the position of the extension bends is adjustable in the radial direction, for example by means of adjusting elements, for example threaded spindles. Advantageously, the position of the extension bends relative to the roller is adjustable. Advantageously, the extension bends are mounted on the side parts. Advantageously, the carrying device is mounted on the side screens of the flat card. Advantageously, the carrying device is mounted on a machined surface, for example of the extension bend. Advantageously, the machined surface, for example of the extension bend, has a defined spacing relative to the central axis of the roller. Advantageously, the carrier has, in each of its end regions, a connecting plate or the like. Advantageously, the movement drive of the grinding device is connected to the machine control system of the flat card or roller card. Advantageously, the movement drive encompasses the advancing movement towards and away from the roller. Advantageously, the movement procedure encompasses the longitudinally directed grinding movement. Advantageously, the duration of grinding is adjustable. Advantageously, the duration of grinding is adjustable in dependence on the usage time (time in operation) of the clothing. Advantageously, the duration of grinding is between about 2 and 120 seconds.

Advantageously, the plurality of grinding elements, for example grinding stones, are arranged next to one another, for example, are arranged in a row. Advantageously, small gaps (spacings), for example not more than 1.0 mm, are provided between the grinding elements. Advantageously, the grinding elements, for example grinding stones, have a width of from about 15 to 1500 mm, for example, about 50 mm.

Advantageously, for the, for example oscillating, movement there is provided an electrical drive element, for example an electric motor; a pneumatic drive element, for example a pneumatic short-stroke cylinder; or a hydraulic drive element. The drive element is advantageously mechanically coupled to the roller drive.

Advantageously, the inner carrier member, to which the grinding elements are attached, is accommodated and guided in an attachment member. Advantageously, the grinding element is attached to a guide pin. Advantageously, the grinding elements are movable across the width of the work at the same time as the movement member. Advantageously, the carrier is an extruded member, for example of aluminium. Advantageously, the attachment member is an extruded member, for example of aluminium. Advantageously, the dimensions of the carrier and of the cover element or work element are the same or substantially the same. The grinding device may be employed in mobile use. The grinding device may be employed in stationary use. The grinding element may be employed in stationary use. The grinding element may be employed in the shape of a parallelogram, of a parallelepiped (rectangular), or of square shape. Advantageously, the plurality of grinding elements are arranged at an angle with respect to the longitudinal axis of the carrier. Advantageously, the grinding elements overlap one another in the grinding direction. Advantageously, the roller is the cylinder of a flat card or roller card; a licker-in of a flat card or roller card; or a doffer of a flat card or roller card. Advantageously, the machine surface, for example of the extension bend, has a defined spacing relative to the circle of tips of the clothing of the cylinder.

The invention also provides an apparatus at a flat card or roller card for grinding a clothing drawn onto a rotating roller, having a carrying device with at least one grinding element and an advancing device serving to set the grind element against the clothing, wherein the apparatus comprise a biasing device serving for automatically continuing to push forward the grinding element in a contact-making direction during the grinding procedure, and wherein the carrying device is attached to the flat card or roller card, wherein carrying element adjusted in respect of a spacing relative to the roller are utilised for adjustment of the biasing device.

Figure 5A:
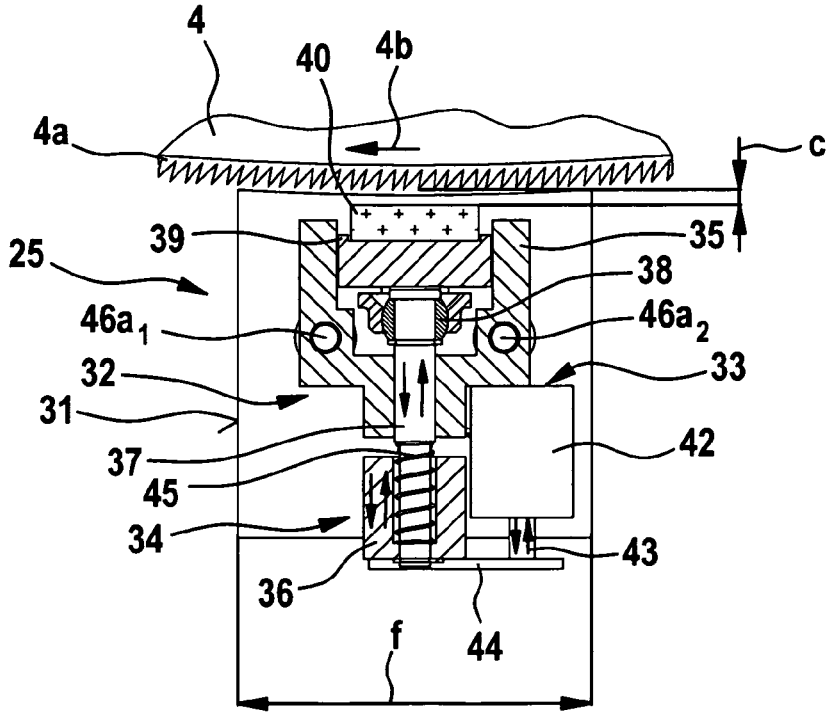
FIG. 5*a* is a sectional side view of a grinding apparatus according to the invention, wherein the grinding elements and the cylinder clothing are out of engagement.

FIG. $\mathbf{5}a_1$ is a detail, to an enlarged scale, of the apparatus of FIG. 5*a;*

Figure 5B:
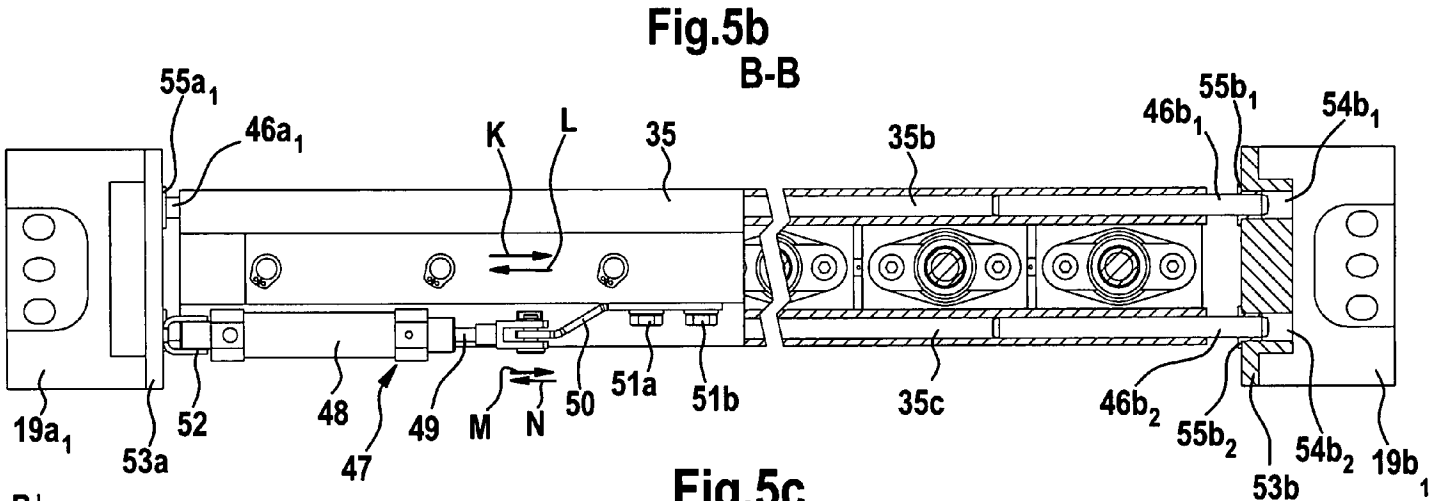

FIG. 5*b* is a top view of and a partial section through the grinding apparatus of the invention according to FIG. 5*a;*

Figure 5C:
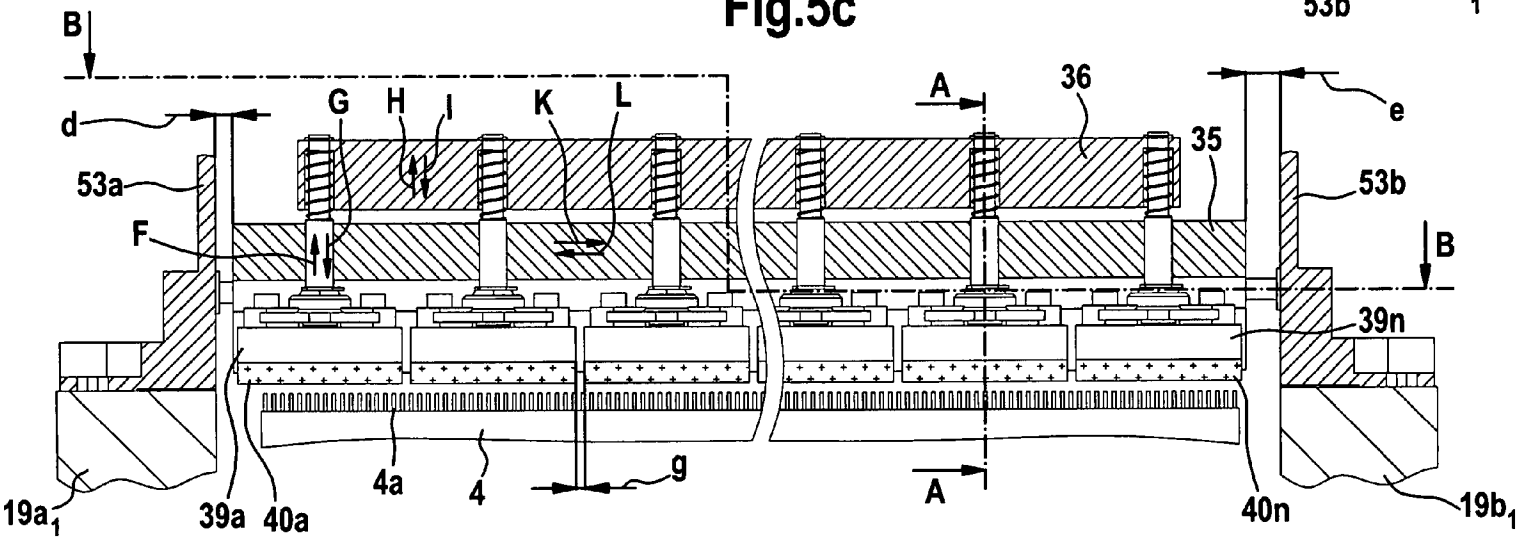

FIG. 5*c* is a sectional view, from the front, through the grinding apparatus of the invention according to FIG. 5*a;*

Figure 6:
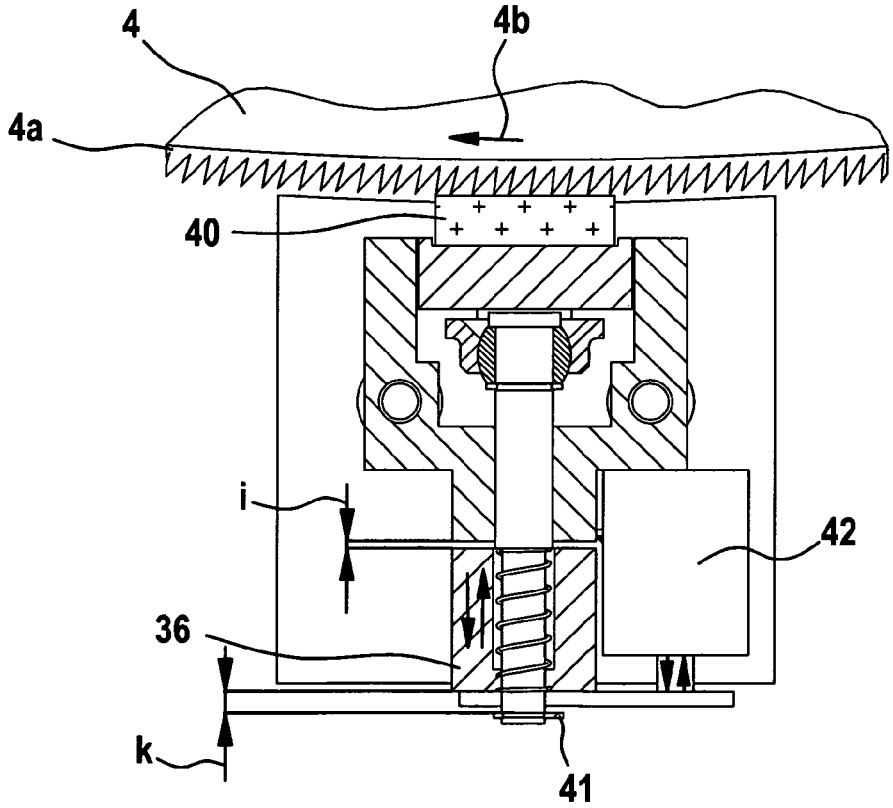

FIG. 6 is a sectional view, from the side, through the grinding apparatus of the invention according to FIG. 5*a*, but with the grinding elements and the cylinder clothing in grinding engagement; and FIGS. 7*a* to 7*d* show four practical forms of arrangement for a plurality of grinding elements.

DETAILED DESCRIPTION OF THE PREFERRED EMBODIMENTS

Figure 1:
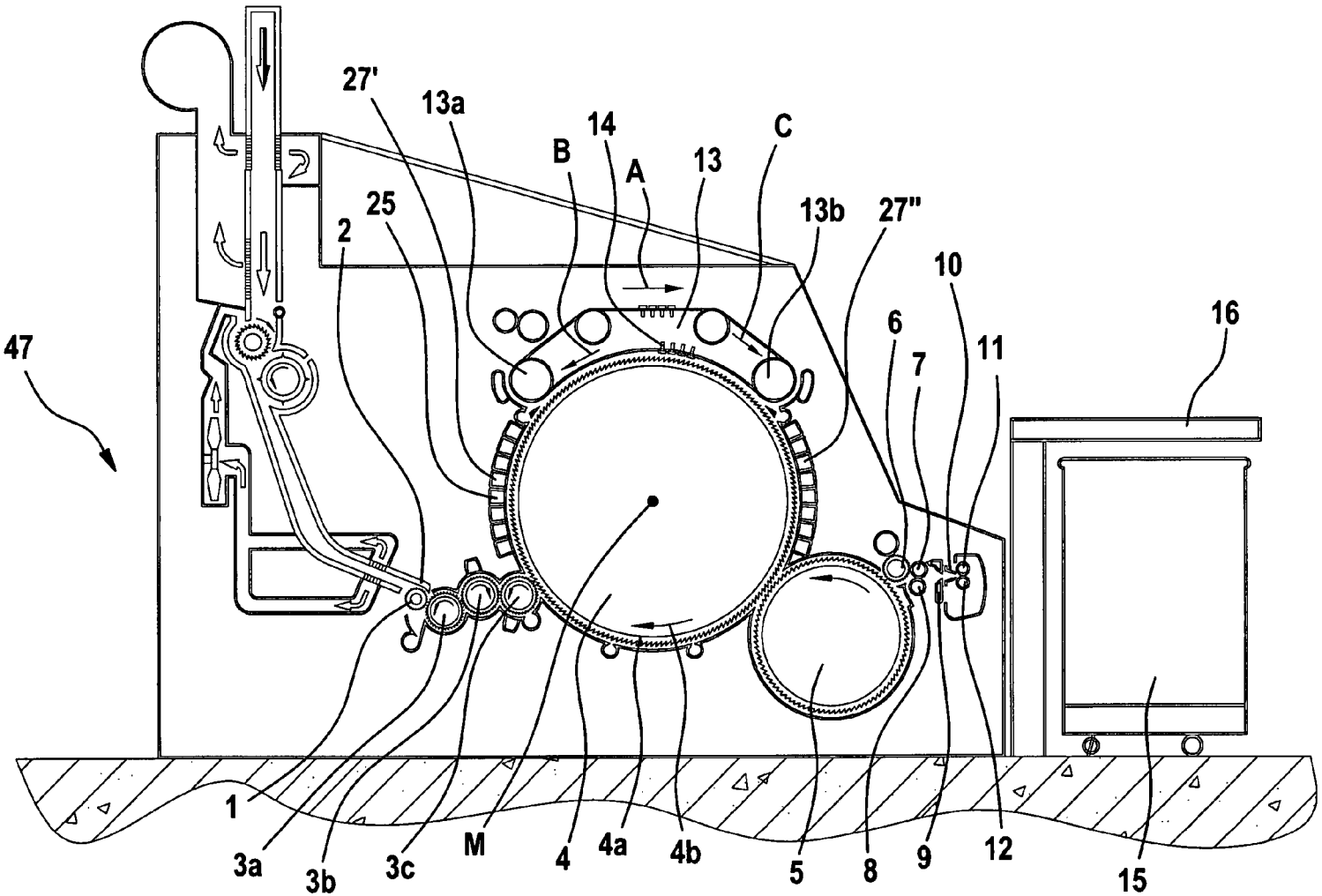
FIG. 1 is a diagrammatic side view of a flat card having a grinding apparatus according to the invention.

FIG. 1 shows a flat card, for example a TC 03 (Trade Mark) flat card made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can cooler 16. The directions of rotation of the rollers are indicated by curved arrows. Reference letter M denotes the centre (axis) of the cylinder 4. Reference numeral 4*a* denotes the clothing and reference numeral 4*b* the direction of rotation of the cylinder 4. Reference letter B denotes the direction of rotation of the revolving card top 13 in the carding position and reference letter C denotes the return transport direction of the flats 14. Between the licker-in 3*c* and the back card top guide roller 13*a* there are arranged immobile cover elements or work elements, for example fixed carding elements 27', and between the front card top guide roller 13*b* and the doffer 5 there are arranged immobile cover elements or work elements, for example fixed carding elements 27". The arrow A indicates the working direction. The curved arrows drawn inside the rollers denote the directions of rotation of the rollers. Reference numeral 25 denotes a grinding apparatus according to the invention.

Figure 2:
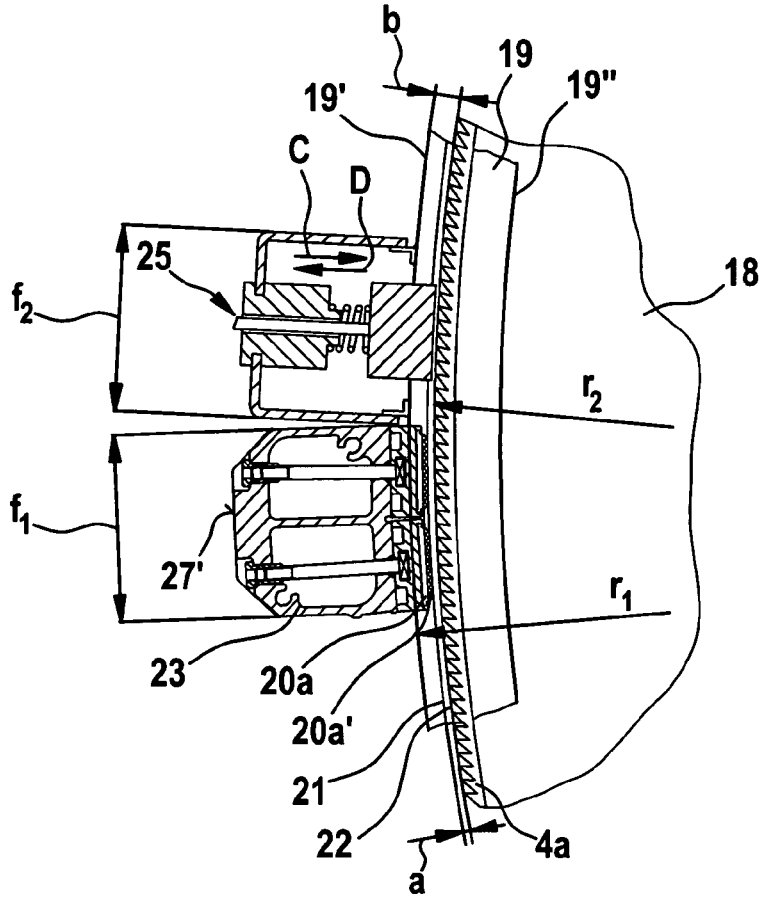
FIG. 2 shows part of a side screen together with a part of an extension bend, on which a grinding apparatus according to the invention and a fixed carding element are mounted.

According to FIG. 2, an approximately semi-circular, rigid side panel 18 is fixed laterally at each end of the machine frame (not shown), on the outside of which panel in the region of the periphery there is concentrically mounted an arcuate supporting element 19 (extension bend), for example using screws, which supporting element has, as supporting surface, a convex outer surface 19' and an underside 19".

Carding elements 27' have, at both their ends, supporting surfaces, which lie on top of the convex outer surface 19' of the supporting element. Mounted on the underside of the carding segment 27' are carding elements 20*a*, 20*b*, which have carding clothings 20'*a*, 20'*b*. Reference numeral 21 denotes the circle of tips of the clothings. The cylinder 4 has, around its circumference, a cylinder clothing 4*a*, for example a saw-tooth clothing. Reference numeral 22 denotes the circle of tips of the cylinder clothing 4*a*. The spacing between the circle of tips 21 and the circle of tips 22 is indicated by the reference letter a and is, for example, 0.20 mm. Reference letter b denotes the spacing between the convex outer surface 19' and the circle of tips 22. Reference $r_1$ denotes the radius of the convex outer surface 19' and reference $r_2$ denotes the radius of the circle of tips 22. The radii $r_1$ and $r_2$ intersect in the centre M (see FIG. 1) of the cylinder 4.

The carding segment 27' according to FIG. 2 consists of a carrier 23 and two carding elements 20*a*, 20*b*, which are arranged one after the other in the direction of rotation (arrow 4*b*) of the cylinder 4, the clothings of the carding elements 20*a*, 20*b* and the clothing 4*a* of the cylinder 4 lying opposite to one another.

The grinding apparatus 25 is arranged next to the carding segment 27', seen in the direction of rotation 4*b* of the cylinder 4. The spring-loaded grinding stone 40 is in grinding engagement with the tips of the cylinder clothing 4*a*. An advancing device 33 (see FIG. 5*a*) brings about displacement of the carrying device for the grinding stone in a radial direction with respect to the cylinder axis M in the direction of the arrows C, D (see FIG. 2), as a result of which the grinding stone is brought into and out of engagement with the cylinder clothing 4*a*.

Figure 3:
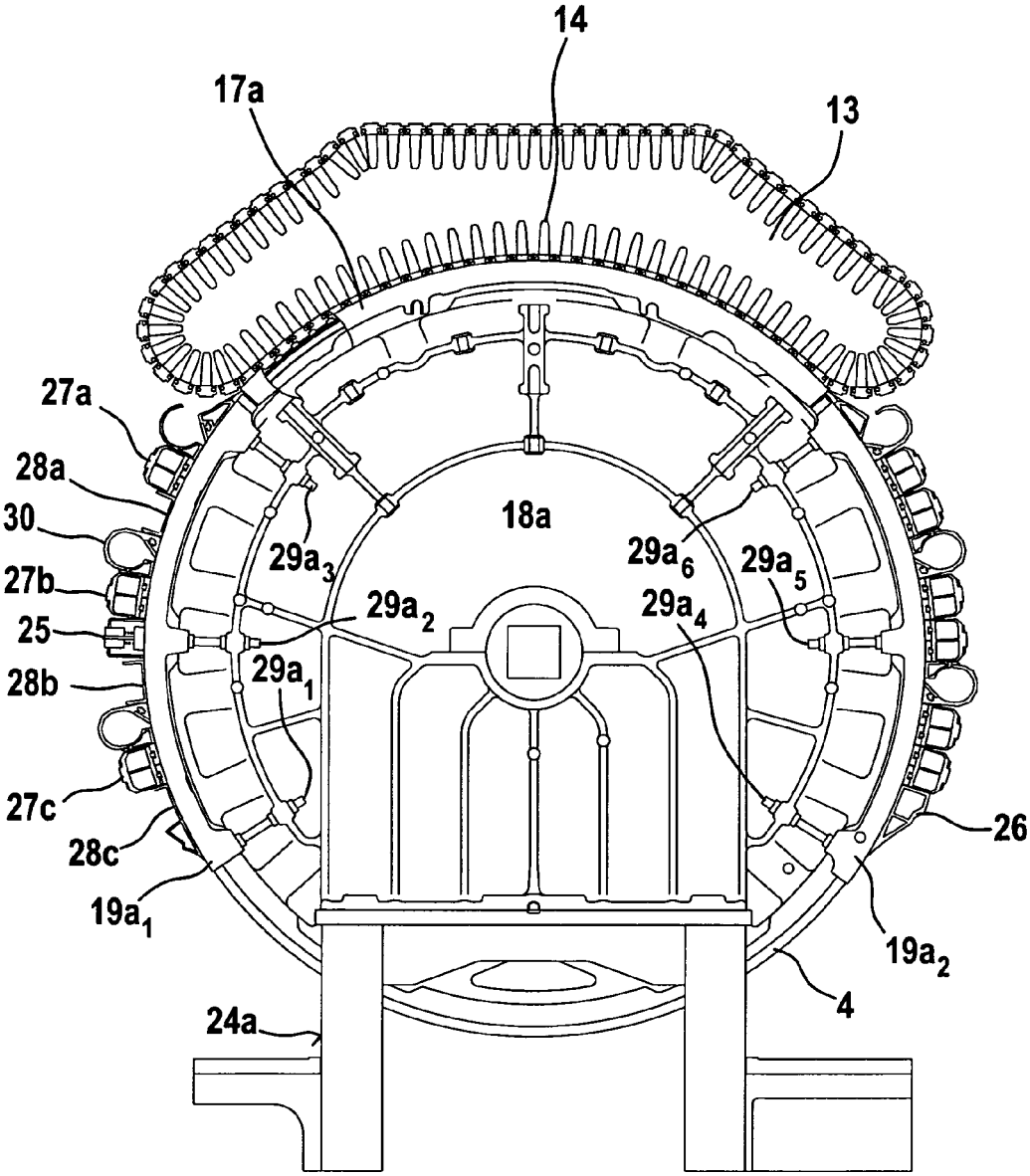
FIG. 3 is a diagrammatic side view of a part of the card showing a side screen together with a flexible bend, cylinder, extension bend, fixed carding elements and a grinding apparatus according to the invention.

In the arrangement shown in FIG. 3, between lickers-in 3 and card top guide roller 13*a* there are three immobile fixed carding elements 27*a*, 27*b*, 27*c* and non-clothed cylinder casing elements 28*a*, 28*b*, 28*c*. The fixed carding elements 27 have a clothing that lies opposite to the cylinder clothing 4*a*. Machine elements, such as the fixed carding elements 27*a* to 27*c*, are attached by way of screws and the cover elements 28*a* to 28*c* are attached by way of screws (not shown) to an extension bend 19*a* or 19*b* (in FIG. 3, only the extension bends $\mathbf{19}a_1$, $\mathbf{19}a_2$ on one side of the flat card are shown), which in turn is fastened by way of screws onto the flat card panel 18*a* and 18*b* (in FIG. 3, only 18*a* is shown) on each side of the flat card. The flexible bends 17*a*, 17*b* (in FIG. 3 only 17*a* is shown) are fastened by way of screws to the side panels 18*a* and 18*b*, respectively. Reference numeral 24*a* denotes the machine frame and reference numeral 30 denotes suction hoods having separating blades. The grinding apparatus 25 according to the invention is mounted between a cover element 28*b* and a fixed carding element 27*b* on the extension bend $\mathbf{19}a_1$.

Figure 4:
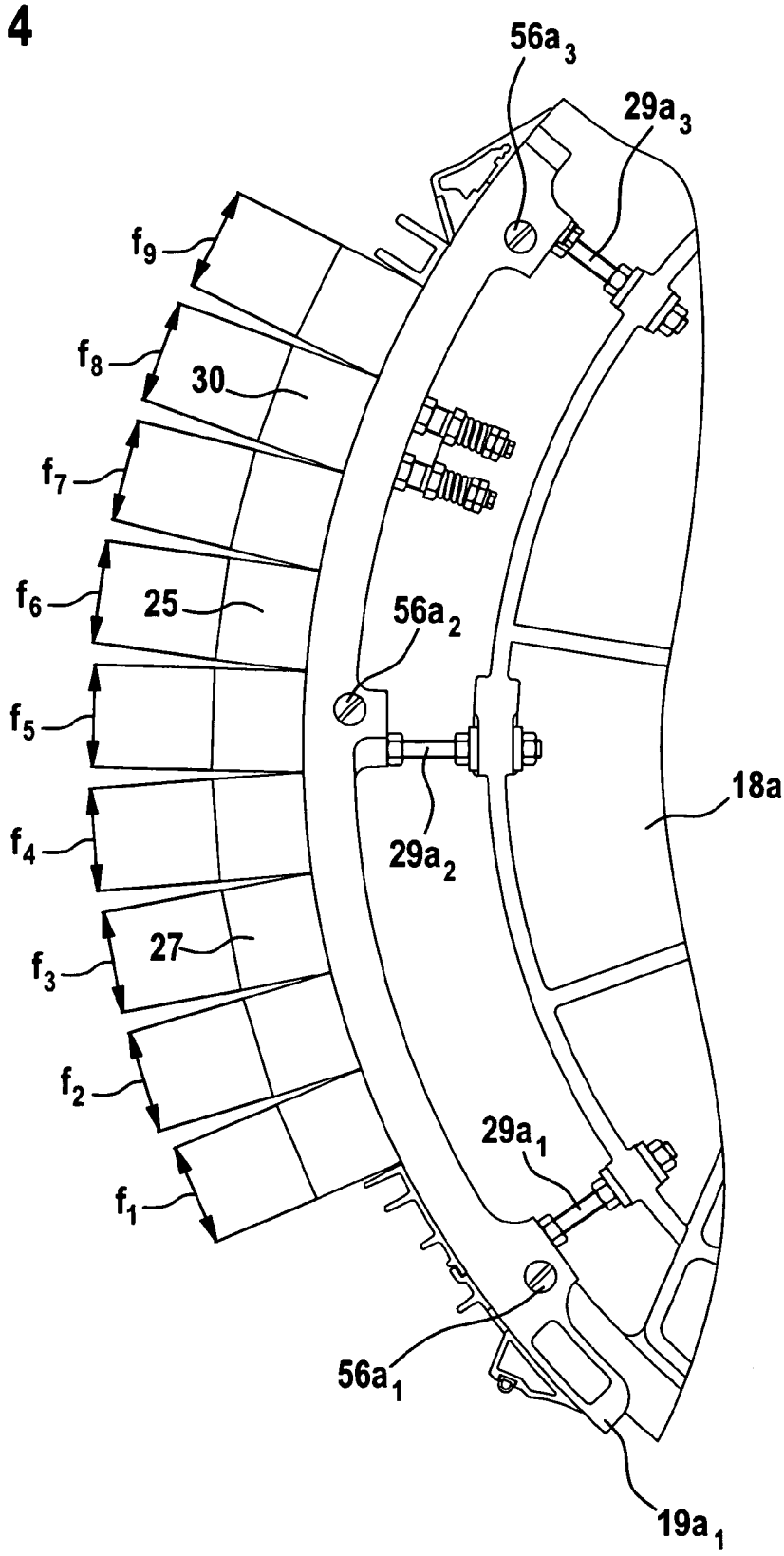
FIG. 4 shows an extension bend together with threaded adjusting spindles and a grinding apparatus according to the invention.
Figure 5A:
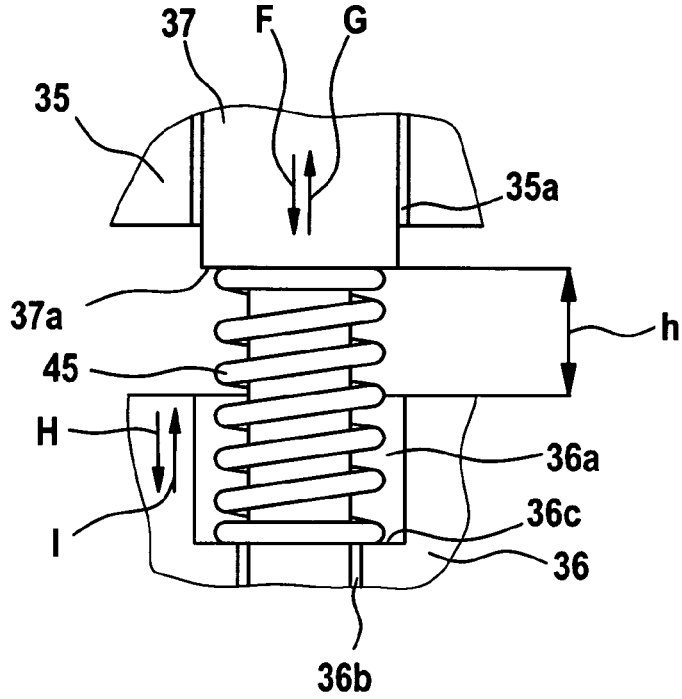

In the arrangement shown in FIG. 4, the extension bends (carrying elements) $\mathbf{19}a_1$, $\mathbf{19}a_2$ and $\mathbf{19}b_1$, $\mathbf{19}b_2$ are fastened on each side of the flat card to a flat card panel 18*a* and 18*b*, respectively. Each extension bend $\mathbf{19}a_1$, $\mathbf{19}a_2$ and $\mathbf{19}b_1$, $\mathbf{19}b_2$ is—in a manner shown in FIG. 4 using the example of the extension bend $\mathbf{19}a_1$—adjustable in the radial direction by means of at least three adjusting spindles $\mathbf{29}a_1$, $\mathbf{29}a_2$, $\mathbf{29}a_3$ (threaded spindles). By this means it is possible to adjust the spacing b (FIG. 2) between the convex outer surface 19' and the circle of tips 22 of the clothing 4*a* of the cylinder. As a result it is also possible to adjust the spacing between the convex outer surface 19' and the centre M (see FIG. 1) of the cylinder 4. As a result, defined spacings are specified between the peripheral region 19' of the extension bend $\mathbf{19}a_1$ and a reference point (circle of tips 22 or centre M). Those defined spacings are utilised for biasing of the biasing device 34 and make separate adjustment of the biasing device unnecessary. The grinding apparatus according to the invention 25 needs only to be set against the clothing 4*a* that is to be ground and/or, as appropriate, to be lifted off therefrom, by means of the advancing device.

The spacing a (FIG. 2) between the clothings of the fixed carding element 27' and the clothing 4*a* of the cylinder 4 can also be adjusted by means of the adjusting spindles $\mathbf{29}a_1$, $\mathbf{29}a_2$, $\mathbf{29}a_3$.

Reference letters $f_1$ to $f_9$ denote the widths of the elements mounted on the extension bend $\mathbf{19}a_1$, for example the grinding apparatus 25, the carding element 27, the suction hood 30 with separating blade, the widths $f_1$ to $f_9$ being the same. The grinding apparatus 25 and a cover element or work element are accordingly interchangeable. It is therefore possible for a cover element or work element to be removed and for a grinding apparatus 25 to be installed in place thereof (exchange). However, it is also possible for the grinding apparatus 25 to be retained permanently mounted on the flat card.

In FIGS. 5*a* to 5*d* there is shown in detail one embodiment of the grinding apparatus according to the invention.

FIG. 5*a* shows the cylinder 4, provided with clothing 4*a*, and the grinding apparatus 25. The grinding apparatus 25 has a housing 31, in which there are provided a carrying device 32 having grinding elements 40, an advancing device 33, a biasing device 34 and a displacement device 47 (see FIG. 5*b*). Reference letter f denotes the width of the housing 31.

The carrying device 32 comprises a guide member 35 and a carrier member 36. Mounted at one end of a guide pin 37, by way of a universal joint 38, is a grinding stone carrier 39 having a grinding stone 40. The guide pin 37 is mounted in a through-hole in the guide member 35 so as to be movable in the direction of the arrows F, G. The other end of the guide pin 37 passes through a through-hole 36*a*, 36*b* in the carrier member 36. A securing ring 41 is attached to the end of the guide pin 37. The guide member 35 and the carrier member 36 are extruded aluminium members. Reference numerals $\mathbf{46}a_1$, $\mathbf{46}a_2$ denote guide pins (see FIG. 5*a*).

The advancing device 33 comprises a pneumatic cylinder 42 having a cylinder rod 43 (piston rod), for example a pneumatic short-stroke cylinder. To the free end of the cylinder rod 43 there is attached a mechanical transmission element 44, for example a flat sheet metal plate or the like, which is additionally fixed to the carrier member 36. As a result of this rigid connection, the cylinder rod 43 and the carrier member 36 are both movable in the same direction. That end face of the cylinder 33 which is remote from the cylinder rod 43 is fixed so that it is supported against the guide member 35. In accordance with that position of the advancing device 33 which is shown in FIG. 5*a*, a spacing c is present between the grinding element 40 and the cylinder clothing 4*a*, that is to say the grinding elements 40 are not in engagement with the cylinder clothing 4*a*.

The biasing device 34 comprises a helical spring 45, for example a compression spring, one end of which is supported on a shoulder 37*a* of the guide pin 37 and the other end of which is supported on a step 36*c* in the hole 36*a* through the carrier member 36.

Referring to FIG. 5*b*, the displacement device 47 comprises a pneumatic cylinder 48 having a cylinder rod 49 (piston rod), for example a pneumatic short-stroke cylinder. At the free end of the cylinder rod 49 there is attached a mechanical transmission element 50, for example a twice-bent sheet metal plate or the like, which is additionally fixed to the guide member 35, for example by screws 51*a*, 51*b*. As a result of this rigid connection, the cylinder rod 49 and the guide member 35 are each movable in the same direction. That end region of the cylinder 48 which is remote from the cylinder rod 49 is fixed so that it is supported against a connecting plate 53*a*. The guide member 35 is in the form of an extruded aluminium member, in which, in lateral hollow passageways 35*b*, 35*c*, there are adhesively bonded pegs 46, for example steel pegs of circular cross-section. Extending out from each of the two end faces of the guide element 35 are pegs 46*a*$_1$, 46*a*$_2$ and 46*b*$_1$, 46*b*$_2$, which are in the form of guide pins. Sleeves 55*a*$_1$, 55*a*$_2$ and 55*b*$_1$, 55*b*$_2$ are fixed in bores 54*a*$_1$, 54*a*$_2$ and 54*b*$_1$, 54*b*$_2$ in the connecting plates 53*a* and 53*b*, respectively. The free ends of the guide pins 46*a*$_1$, 46*a*2 and 46*b*$_1$, 46*b*$_2$ engage in the openings of the sleeves 55*a*$_1$, 55*a*$_2$ and 55*b*$_1$, 55*b*$_2$, respectively, in a manner allowing displacement in the direction of the arrows K, L. FIG. 5*c* shows different spacings d and e between, on the one hand, those end faces of the connecting plates 53*a*, 53*b* that face one another and, on the other hand, the end faces 35*d*, 35*e* of the guide member 35. By means of the displacement device 47 and displacement of the cylinder rod 49 in the direction of the arrows M, N, the guide member 35 and with it, at the same time, the carrier member 36 are accordingly pushed back and forth in the direction of the arrows K, L.

According to FIG. 5*c*, a plurality of grinding elements 40*a* to 40*n*, for example grinding stones, are arranged over the width of the grinding apparatus 25 or cylinder 4 next to one another in a row. The spacing g between grinding elements 40*a* to 40*c* arranged one another is, for example, less than 1.0 mm. The duration of grinding governs the amount of material removed from the clothing 4*a* and varies between, for example, 2 and 120 seconds. During the grinding procedure, the grinding elements 40*a* to 40*c* carry out a reciprocating or oscillating movement back and forth in the directions K, L.

In the course of advancing (setting against the clothing 4*a*), the advancing device 33 moves in the direction of the arrow G and in the course of the return movement (lifting off from the clothing 4*a*) the advancing device 33 moves in the direction of the arrow F. During movement of the advancing device 33 in the directions F, G, the guide member 35 remains immobile (stationary). In the course of the grinding movement, both the guide member 35 and also the carrier member 36 are moved in the direction of the arrows K, L.

With reference to FIG. 6, in contrast to what is shown in FIG. 5*a*, the grinding element 40 is in grinding engagement with the clothing 4*a*. As a result of actuation of the cylinder 42, the carrier member 36 is moved in the direction of the arrow I. As a result, the spacing shown in FIG. 5*a*$_1$ as h, between the carrier member 36 and the guide member 35, has been reduced to the spacing i. At the same time, the spacing between the securing ring 41 and the carrier element 36 has been increased, compared to FIG. 5*a*, to the spacing k.

Figure 7A:
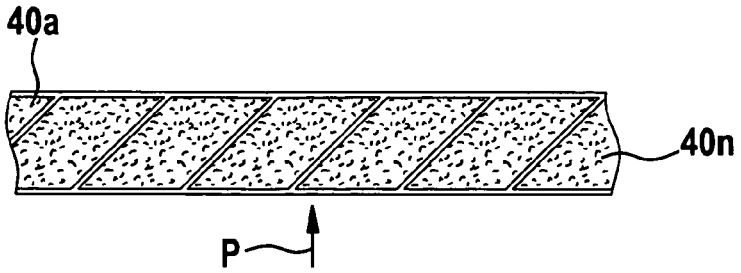
Figure 7B:
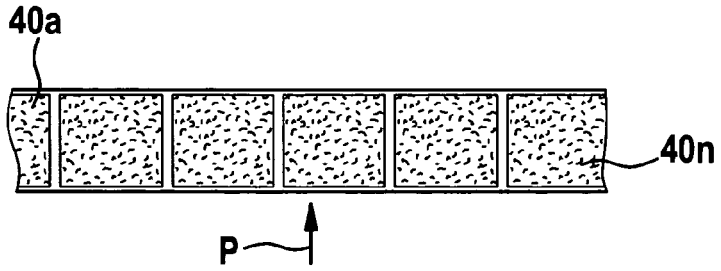
Figure 7C:
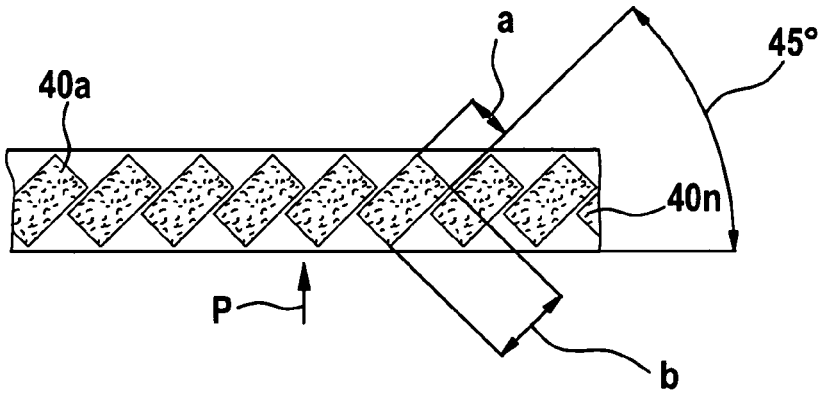
Figure 7D:
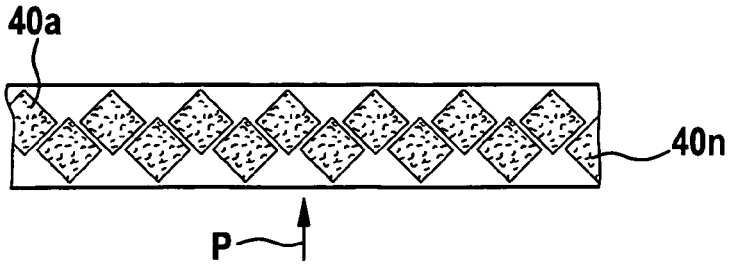

In the embodiment of FIGS. 7*a* to 7*d*, the grinding surfaces of the grinding elements 40*a* to 40*n* are arranged next to one another in a row. In the embodiment of FIG. 7*a*, the grinding surfaces of the grinding elements 40*a* to 40*n* are in the shape of parallelograms. The adjacent edges of the grinding elements 40*a* to 40*n* form an angle relative to the grinding apparatus P. In the embodiment of FIG. 7*b*, the grinding elements 40*a* to 40*n* are in the shape of parallelepipeds. Those edges of the grinding elements 40*a* to 40*n* which face one another are oriented parallel to the grinding apparatus P. In the embodiment of FIG. 7*c*, the grinding elements 40*a* to 40*n* are in the shape of parallelepipeds. They have a grinding surface having two short edges a and two long edges b, the ratio a:b being equal to 1:2. The angle of the edges $\gamma$ with respect to the grinding apparatus P is $\alpha$=45°. In the embodiment of FIG. 7*d*, the grinding surfaces of the grinding elements 40*a* to 40*n* are of square shape and the edges of the grinding elements 40*a* to 40*n* are arranged at an angle $\alpha$ with respect to the grinding apparatus P.

Advantageously, the grinding apparatus 25 can be replaced by a functional component such as an MTT cassette of the flat card or roller card, without having to adjust or orient that device relative to the roller (cylinder 4). This means that this device can be used for a particular machine and is factory-calibrated. The grinding apparatus has connecting plates 53*a* to 53*b* on the right-hand and left-hand sides, by means of which it can be connected directly to the extension bend 10 or to a machined surface on the side panel 18 of the roller 4. The spacings of the extension bends 19 with respect to the cylinder 4 are always adjusted for supporting functional components such as an MTT cassette, MTT suction hood and cover members. There is accordingly no need for additional fixing arms or for alignment or preadjustment of the grinding device 35 in the machine. The grinding apparatus 25 is suitable for mobile use and for stationary use in a spinning room machine which has rollers with clothings. Preferably, the device remains in the flat card or roller card and the grinding process is specified by the machine control system. The duration of grinding governs the amount of material removed from the clothing and varies between 2 and 120 seconds. This device has one or more grinding elements 40, which have a reciprocating or oscillating movement. Preferably, the grinding elements 44 are arranged next to one another in a row, it being possible to produce gaps (spacings) between the grinding elements 40 which are as small as possible (<1.0 mm). The grinding elements 40 preferably have a width of from 15 to 1500 mm; in the preferred arrangement, the width is 50 mm. The grinding stones 40 are accommodated in a guide member 35 and are fixed thereto by means of a guide pin 37 and, in the process, mounted on a universal joint. When the number of grinding elements is >1, an oscillating movement is, because of the gaps, required in the longitudinal direction (in the direction of the width of the work) so that all the teeth of the clothing 4*a* are uniformly re-ground and activated over the width of the work. That oscillating movement can be accomplished by means of an electrical, electromagnetic, pneumatic or hydraulic drive. Mechanical coupling to the cylinder drive or roller drive is likewise possible. A preferred arrangement has a pneumatic short-stroke cylinder in this location. The guide member 35, to which the grinding elements are fixed by means of the guide pin, is accommodated and guided in a carrier member 36. The grinding elements 46 can, at the same time, be moved relative to the carrier member 36 and can be advanced towards or moved away from the clothed roller 4 or clothed component. As a result, the grinding procedure can be switched on and switched off. The duration of grinding is dependent on the usage time of the clothing 4*a* and can be varied and controlled. Further preference is given to the grinding device being a part of the machine and the grinding procedure being specified by the control system of the machine. Advantageously, the guide member 35 and the carrier member 36 are extruded members of aluminium, in order to keep down the weight of the components. In addition, the component width f and height (cross-section) correspond approximately to those of an MTT cassette so that, instead of a TwinTop, the grinding device 25 can be installed in a flat card.

Although the foregoing invention has been described in detail by way of illustration and example for purposes of understanding, it will be obvious that changes and modifications may be practiced within the scope of the appended claims.

What is claimed is:

1. A grinding device for grinding a clothing on a rotating roller of a carding machine, the carding machine including carrying elements, the grinding device comprising:

a carrying device with at least one grinding element and an advancing device serving to set the grinding element against the clothing; and a biasing device for automatically continuing to push forward the grinding element in a contact-making direction during the grinding procedure;

wherein the carrying elements of the carding machine are adjustable to adjust a spacing between the rotating roller and at least one machine element opposed to the rotating roller, and the grinding device is arranged so that the adjustment of the carrying elements of the carding machine also effects adjustment of the biasing device.

2. A device according to claim 1, in which a plurality of cover elements and/or work elements are associated with the rotating roller, the grinding device with the grinding element and a cover element and/or work element being interchangeable.

3. A device according to claim 1, in which during the grinding process at least one grinding element carries out a reciprocating movement back and forth in a direction substantially perpendicular to the directing of action of the biasing device.

4. A device according to claim 3, further comprising a movement drive device for effecting a displacement of the grinding element along a displacement path, and further effecting the advancing movement towards and away from the rotating roller.

5. A device according to claim 4, wherein the movement drive device is selected from the group consisting of an electrical drive device; a pneumatic drive device; and a hydraulic drive device.

6. A device according to claim 1, in which the at least one grinding element has an articulated connection to the biasing device by means of a universal joint.

7. A device according to claim 1, in which the carrying device, together with the biasing device for the at least one grinding element, is arranged to be movable in the contact-making direction.

8. A device according to claim 1, wherein the biasing device has an articulated connection with the grinding element.

9. A device according to claim 1, wherein the carrying device comprises two end regions, each end including at least one connecting member.

10. A device according to claim 1, comprising an adjustment device for adjusting the duration of grinding.

11. A device according to claim 1, in which, in the direction of the clothing surface to be ground, a plurality of grinding elements are provided.

12. A device according to claim 1, in which the or each grinding element has a width of from about 15 to 1500 mm.

13. A device according to claim 1, further comprising an inner carrier member attached to the grinding elements to accommodate and guide in an attachment member.

14. A device according to claim 1, in which the grinding device is usable in a plurality of locations on the carding machine.

15. A device according to claim 1, wherein the grinding device is arranged for permanent retention in its location in use on the carding machine.

16. A device according to claim 1, in which there is a plurality of grinding elements arranged at an angle with respect to a longitudinal axis of the carrying device.

17. A carding machine, comprising:

a rotating roller including clothing;

carrying elements adjustable relative to the rotating roller to adjust a position of at least one machine element opposed to the rotating roller;

a grinding device for grinding the clothing on the rotating roller of the carding machine, the grinding device including:

a carrying device with at least one grinding element and an advancing device serving to set the grinding element against the clothing of the rotating roller; and a biasing device for automatically continuing to push forward the grinding element in a contact-making direction during a grinding procedure;

wherein the grinding device is mounted on the carding machine such that the adjustment of the carrying elements of the carding machine also effects adjustment of the biasing device.

18. A carding machine according to claim 17, further comprising side parts located around the rotating roller, wherein the side parts include the carrying elements, wherein a peripheral region of the carrying elements having predetermined spacings relative to a reference point of the rotating roller, and wherein the carrying device is connected to the carrying element.

19. A carding machine according to claim 18, wherein the carrying elements comprise extension bends and the carrying device is mounted on the extension bends of the carding machine, the position of the extension bends being adjustable in the radial direction.

20. A carding machine according to claim 19, in which the extension bends are mounted on side parts of the carding machine.

21. A carding machine according to claim 18, in which there is a movement drive for effecting movement of the at least one grinding element along the grinding device and the movement drive of the grinding device is connected to the machine control system of the carding machine.

22. A carding machine according to claim 18, in which the rotating roller is a carding cylinder, a licker-in, or a doffer.

* * * * *